United States Patent [19]

Willis

[11] Patent Number: 4,479,414

[45] Date of Patent: Oct. 30, 1984

[54] DRUM SUPPORT ASSEMBLY

[76] Inventor: Ward L. Willis, P.O. Box 95, Breinigsville, Pa. 18031

[21] Appl. No.: 419,984

[22] Filed: Sep. 20, 1982

[51] Int. Cl.[3] ..... G10D 13/02

[52] U.S. Cl. ..... 84/421

[58] Field of Search ..... 84/411 R, 421

[56] References Cited

U.S. PATENT DOCUMENTS 3,433,115 3/1969 Kjelstrom ..... 84/411

3,955,465 5/1976 Zickos ..... 84/411 R 4,112,807 9/1978 Quibell ..... 84/411 R 4,337,684 7/1982 LeMert ..... 84/421

*Primary Examiner*—Donald A. Griffin

*Attorney, Agent, or Firm*—James C. Simmons

[57] ABSTRACT

A multiple drum support assembly containing several supports for positioning drums and cymbals in playing position the support being attached to a bass drum or a pair of bass drums. The support can be folded into a storage or travel position wherein all auxiliary drum supports are parallel to each other.

10 Claims, 7 Drawing Figures

FIG. 4
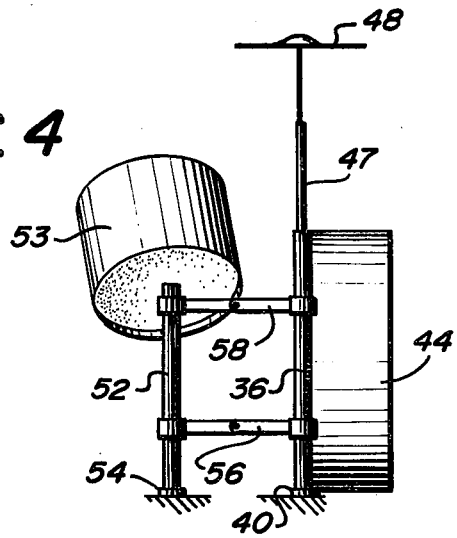
FIG. 5
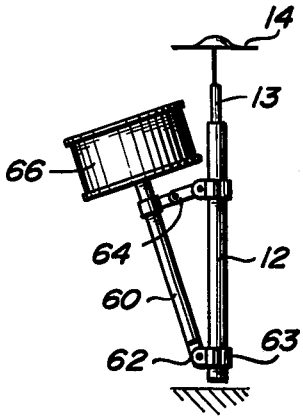
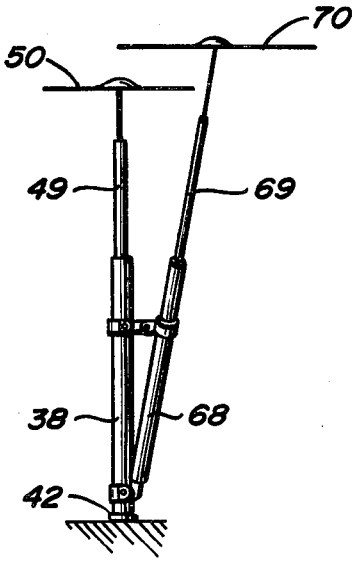
FIG. 6
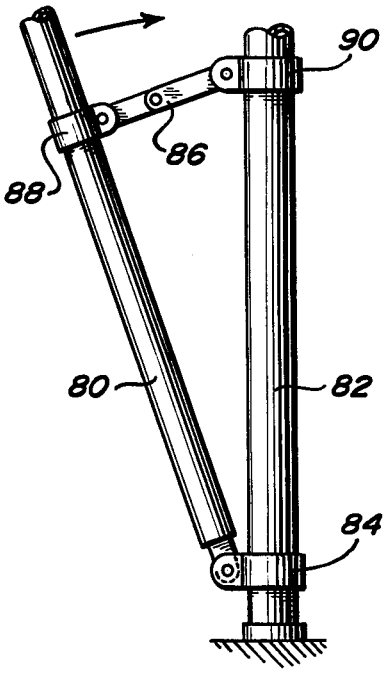
FIG. 7

DRUM SUPPORT ASSEMBLY

TECHNICAL FIELD

The present invention pertains to drum supports or stands used to position an array of drums, cymbals and other percussion instruments in position to be played by a musician.

BACKGROUND OF THE PRIOR ART

U.S. Pat. Nos. 3,433,115 and 4,337,684 are representative of stands that are used to support an array of percussion instruments for playing by a musician. Conventional stands require dismounting of all instruments and a large degree of disassembly for storage and/or travel to another location.

BRIEF SUMMARY OF THE INVENTION

One embodiment of an improved drum stand capable of rapid set-up and take down was created by utilizing a center post to which a pair of support frames used to position percussion instruments such as bass drums are hinged so that said support frames can be brought into face-to-face relationship with or without the percussion instruments attached for storage and/or travel. Additional structures are pivotable and hingedly attached to said center post and support frames to be brought parallel to said center post for storage or travel or positioned relative to said frames for supporting percussion instruments in a playing position relative to the percussion instruments, e.g. bass drums fixed to the support frames.

Alternatively the stand can contain a single frame with side supports to which additional supports are hingedly and pivotably attached to be brought parallel to said side supports for storage or travel or positioned relative to said frame for supporting percussion instruments in a playing position relative to a bass drum fixed to the frame.

BRIEF DESCRIPTION OF THE DRAWING

FIG. 4 is a view taken along the line 4—4 of FIG. 1.

FIG. 5 is a view taken along the line 5—5 of FIG. 1.

FIG. 6 is a view taken along the line 6—6 of FIG. 1.

FIG. 7 is an enlarged view showing details of the pivotable stanchion subassembly.

DETAILED DESCRIPTION OF THE PREFERRED EMBODIMENT

Figure 1:
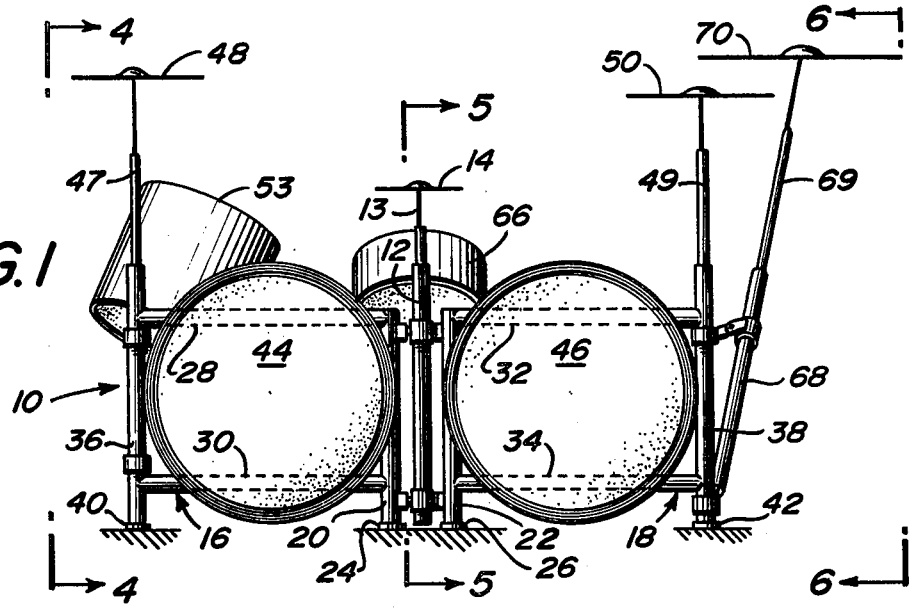
FIG. 1 is a front elevational view of the support assembly according to one embodiment of the present invention with an array of percussion instruments positioned for playing.
Figure 2:
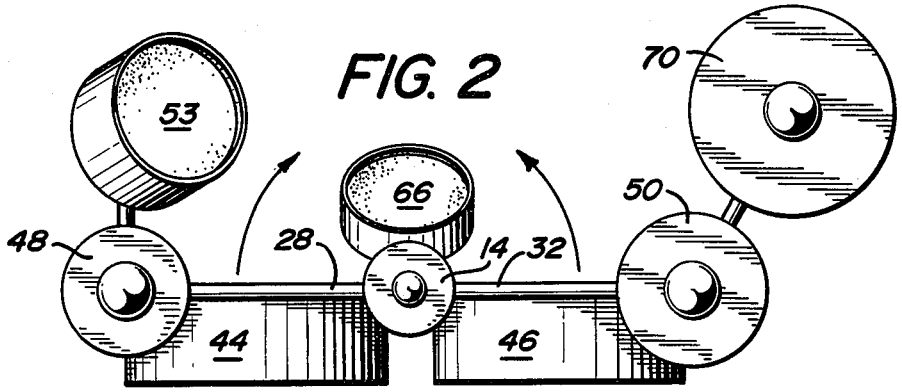
FIG. 2 is a top plan view of the assembly of FIG. 1.
Figure 3:
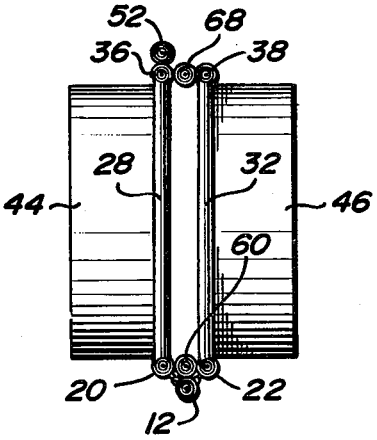
FIG. 3 is a top plan view of the assembly of FIG. 1 with only bass drums attached and the assembly folded for storage or travel.

Referring to FIG. 1 support assembly 10 includes a center post 12 which may have disposed therein a telescoping support or stand 13 for a cymbal or cymbal assembly 14. Conventional telescoping posts can be adapted to fit within outer post 12. Hinged to center post 12 are a pair of support frames 16, 18 constructed of hollow elongated members such as tubes joined together as by welding to form a generally rectangular frame. Each of frames 16, 18 has respectively a first vertical support or leg 20, 22 hinged to center post 12 and adapted to sit on a permanent surface such as a stage by means of feet 24, 26, a pair of horizontal members 28, 30 and 32, 34 fixed to vertical support or leg 36, 38 having feet 40, 42. Vertical supports, stanchions or legs 36, 38 can be adapted to hold telescoping supports 47, 49 for other percussion instruments such as cymbals 48, 50. As shown in FIG. 2, frames 16 and 18 can be folded toward one another to assume the storage or travel position as shown in FIG. 3. Frames 16 and 18 can be used to permanently mount a pair of bass drums 44, 46 for positioning in a playing or side-by-side arrangement (FIGS. 1 and 2) or storage in a face-to-face relationship, (FIG. 3). Bass drums 44, 46 need not be permanently mounted on frames 16, 18 but are required to be in place when the support assembly is in use.

Support frames 16, 18 need not be of rectangular shape and can be circular or other convenient shape to support drum 44, 46, however vertical supports 12, 20, 22, 36 and 38 must be used to support auxiliary equipment as will hereinafter be more fully described.

Referring to FIG. 4, an auxiliary support stanchion, post or leg 52 used to hold a percussion instrument such as a tom-tom 53, adapted by foot 54 to contact the surface on which the support assembly 10 rests in its playing or open position is hingably connected to leg 36 or 38 it being shown in relation to leg 36 for illustration only. Hinges 56, 58 can be center pinned bar links as shown or other hinge apparatus to permit leg 52 to fold for storage or travel parallel to its support frame leg as shown in FIG. 3.

FIG. 6 illustrates yet another percussion instrument support 69 which can be mounted on leg 36 or 38 it being shown in association with leg 38 for illustration only. Support 68 is fixed to a leg in a manner similar to that used to fix support 60 to post 12 and can be used to hold a telescoping support 69 which in turn holds a percussion instrument such as cymbal 70.

FIG. 7 details means of a swivel hinge arrangement for mounting an auxiliary post 80 to leg 82. Auxiliary post 80 is pinned to a collar 84 which is mounted for rotation about the leg 82 thus permitting post 80 to be disposed next to and parallel to leg 82 or angularly thereto as shown in FIG. 7. Movement of post 80 relative to leg 82 is controlled by a pinned folding link mechanism 86 securely fastened to post 80 by collar 88 and to leg 82 by a rotating collar 90.

While the auxiliary posts 60 and 68 can be mounted to rotate about this support leg, they can also be mounted for angular disposition to the leg without rotating.

In another embodiment of the invention a single frame with side support legs can be used with a single base drum. Side supports such as leg 52 can be used with either or both support legs to support auxiliary percussion instruments. In addition auxiliary posts such as 60, 68 can be used on the side support legs or auxiliary legs to support additional instruments arranged in a playing position relative to the bass drum.

Having thus described my invention, what is desired to be secured by Letters Patent of the United States is set forth in the appended claims.

I claim:

1. A multiple drum and cymbal holding assembly comprising in combination:

a center post or stanchion including means to mount at least two different percussion instruments;

a pair of support frames hinged to said center post for positioning percussion instruments such as bass drums in a playing position relative to other instruments mounted on said center post, to be positioned in face-to-face relationship for travel and storage and side-by-side relationships for supporting instruments for playing; and means to position auxiliary percussion instruments on said frames.

2. An assembly according to claim 1 including an outrigger pole or stanchion pivotably connected to said center post with means to position said outrigger at an angular relation to said center post for supporting a drum or cymbal assembly in playing position and positioning said outrigger parallel to said center post for storage or travel.

3. An assembly according to claim 2 wherein said outrigger supports a snare drum when in playing position and said center post has disposed therein a telescoping cymbal support.

4. An assembly according to claim 1 including an auxiliary stanchion or support hinged to one of said support frames to support a tom-tom or like drum in playing position said stanchion being folded parallel to said frame for storage and/or transport.

5. An assembly according to claim 4 wherein said support frame supporting said hinged stanchion includes a post supporting a telescoping cymbal assembly in playing proximity to said drum.

6. An assembly according to claim 5 wherein said frame supports a telescoping cymbal assembly adjacent said angularly positioned stanchion.

7. An assembly according to claim 4 wherein the other of said supporting frames includes a stanchion pivotably connected to said frame and vertically angularly positionable thereto for holding a cymbal assembly in playing position.

8. An assembly according to claim 1 wherein all members are tubular in cross-section and disposed vertically or horizontally relative to each other when in the travel or storage position.

9. A multiple drum and cymbol holding assembly comprising in combination:

a support frame adopted for mounting on a bass drum;

a pair of support legs disposed on either side of said frame; and means to position auxiliary percussion instruments on said support legs, said means foldable to store parallel to said support legs for storage or travel.

10. An assembly according to claim 9 wherein said means for supporting auxiliary equipment includes outrigger poles and/or auxiliary legs hingedly or pivotable secured to said side posts.

* * * * *